US005386855A

United States Patent [19]

Corain et al.

[11] Patent Number: 5,386,855

[45] Date of Patent: Feb. 7, 1995

[54] DEVICE FOR AUTOMATICALLY VARYING THE POSITION OF THE SHED VERTEX IN A LOOM

[75] Inventors: Luciano Corain, Vicenza; Spanevello Roberto, Schio; Marco Novella, Valdagno, all of Italy

[73] Assignee: Nuovopignone-Industrie Meccaniche E Fonderia SpA, Florence, Italy

[21] Appl. No.: 136,450

[22] Filed: Oct. 14, 1993

[30] Foreign Application Priority Data

Oct. 23, 1992 [IT] Italy ..... MI92A 002424

[51] Int. Cl.[6] ..... D03D 51/00; D03D 49/10

[52] U.S. Cl. ..... 139/99; 139/110; 139/304; 139/311; 139/1 E

[58] Field of Search ..... 139/99, 1 R, 110, 304, 139/309, 311, 1 E

[56] References Cited

U.S. PATENT DOCUMENTS

| | | | |
|---|---|---|---|
| 3,878,872 | 4/1975 | Hintsch | 139/110 X |
| 4,585,037 | 4/1986 | Kimbara | 139/1 E |
| 4,619,294 | 10/1986 | Sainen et al. | 139/311 X |
| 4,817,677 | 4/1989 | Deconinck et al. | 139/311 X |
| 5,090,452 | 2/1992 | Benelli | 139/110 X |
| 5,224,520 | 7/1993 | Shinbara et al. | 139/110 X |

FOREIGN PATENT DOCUMENTS

| | | | |
|---|---|---|---|
| 9108796 | 9/1991 | Germany . | |
| 63-3288250 | 11/1988 | Japan | 139/1 E |
| 537111 | 4/1993 | Japan | 139/110 |
| 668997 | 2/1989 | Switzerland . | |

*Primary Examiner*—Andrew M. Falik
*Attorney, Agent, or Firm*—Morgan & Finnegan

[57] ABSTRACT

A device for automatically varying, during the transient states following loom stoppages, the shed vertex position in the loom. The device consists of a sensor for determining the beat-up pulse intensity of the loom reed. The device also is connected to a comparator which receives a predetermined set value corresponding to the beat-up pulse intensity of the reed during normal operation. The output of the comparator is used, through a control unit, to synchronously drive the electric motors that operate the beam and the take-up roller of the loom, respectively.

2 Claims, 1 Drawing Sheet

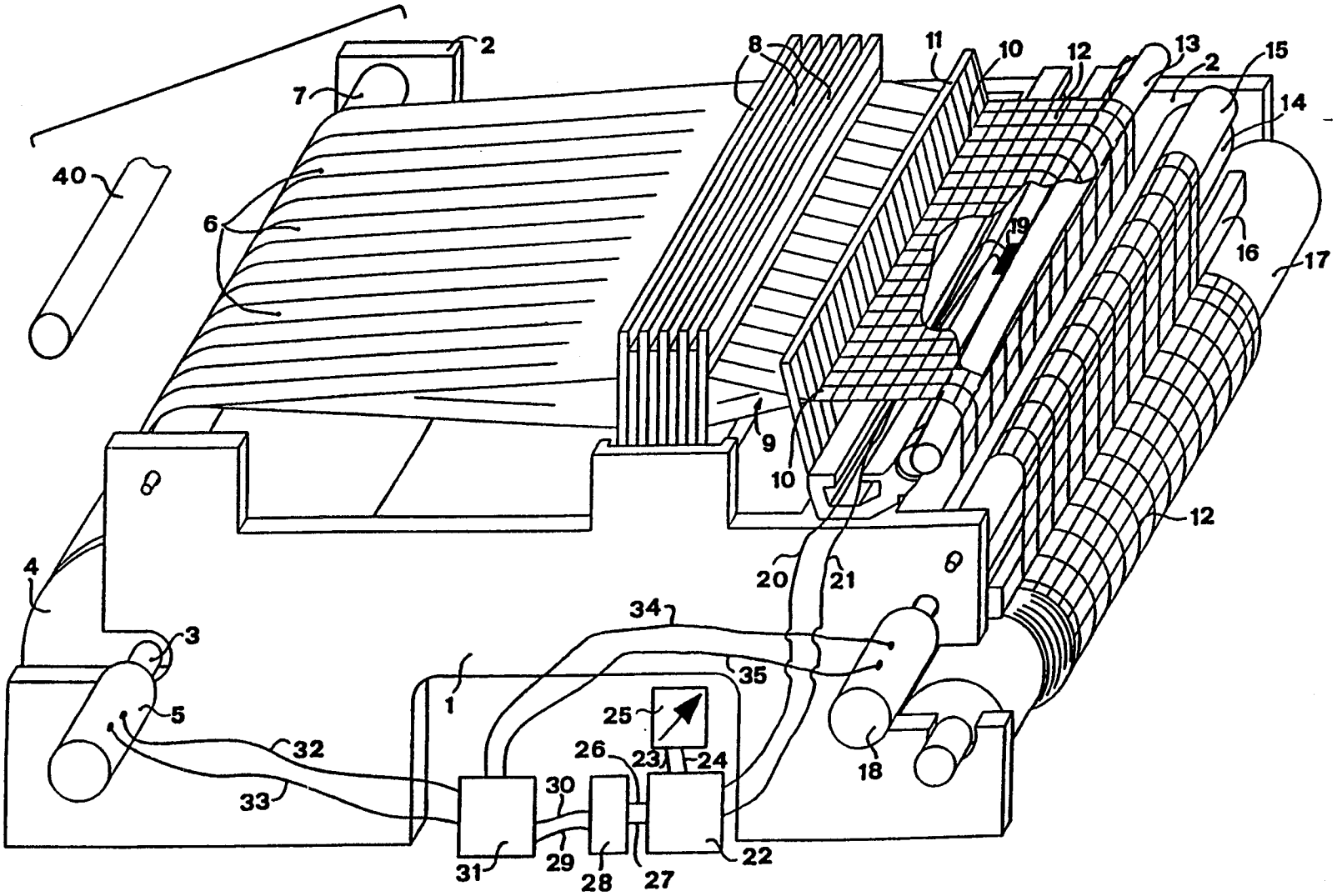
17
14
15
16
2
13
12
12
10
19
11
8
10
9
20
21
18
22
24
23
25
26
27
28
29
30
31
35
34
1
2
7
6
32
33
3
5
4
40

DEVICE FOR AUTOMATICALLY VARYING THE POSITION OF THE SHED VERTEX IN A LOOM

BACKGROUND OF THE INVENTION

1. Field of the Invention

This invention relates to a device which, by automatically adjusting the position of the shed vertex cloth fell in said loom during the transient states following loom stoppages in such a manner as to maintain the reed beat-up intensity always equal to its normal working intensity, enables a defect-free fabric to be woven continuously.

2. Description of the Prior Art

As is well known, because of its inertia the loom, after each stoppage, achieves its working speed only after a transient state during which the weft is beaten up by the reed at an intensity less than the working intensity, with the result that the weft does not finish up in the same position as the wefts subsequently beaten up at working intensity, so that a defect visible to a greater or lesser extent depending on the difference in beat-up intensity appears in the fabric due to differing weft density. Said defect, which up to a short time ago was substantially unnoticeable and hence was not a problem given the relatively low speed of the looms used, because of which the intensity with which the first weft after loom stoppage was beaten up was substantially very close to working intensity, has now become visible and hence unacceptable, because of the high speed of modern looms.

To obviate this drawback, it has been sought to restart the loom as rapidly as possible so as to quickly attain working speed and hence beat-up the first weft after loom stoppage with an intensity as close as possible to the working intensity.

In practice, the coil of the electromagnet which attracts the friction disc is overpowered for the entire transient state period so as to nullify disc slippage.

This known method has considerably lessened the problem of fabric defects during transient states after loom stoppages but has not completely solved it, because in addition to the fact that the weft is still beaten up at an intensity slightly different from the working intensity, the vertex of the shed forming the fabric generally moves during loom stoppage because of the plastic deformation of the warp and fabric, and in addition the inevitable friction produced during the movement of the fabric itself results in a variation in the position of the vertex of said shed, so that the wefts are beaten up during transient states in different positions than during normal working.

Attempts have been made to overcome these latter drawbacks involving variation in the position of the shed vertex by locking the take-up roller and/or beam in position during the transient states.

This has considerably limited said vertex position variation but has not completely nullified it.

Hence notwithstanding the various methods used up to the present time, there still remains the drawback that during transient states the weft is not beaten up in the same position as during normal working because there is always a more or less accentuated shift in the position of the shed vertex.

SUMMARY OF THE INVENTION

The object of the present invention is to obviate the said drawback by providing a device which automatically adjusts the shed vertex position in the loom during transient states in such a manner as to maintain the reed beat-up intensity always equal to its normal working intensity, so obtaining uniform fabric density even during transient states.

An illustrative device for automatically varying, during the transient states following loom stoppages, the shed vertex position in said loom, which comprises inter alia a warp feed beam operated by an electric motor synchronized with the loom drive shaft, a reed for beating up the weft against said shed vertex, a fixed bar for deviating the fabric under formation and a take-up roller operated by an electric motor also synchronized with the loom drive shaft, is characterized according to the present invention by a sensor for determining the beat-up pulse intensity of said reed that is connected to a comparator, which also receives a predetermined set value corresponding to the beat-up pulse intensity of said reed during normal working. The output of said comparator being used, via a control unit, to synchronously drive said electric motors operating said beam and said take-up roller. According to a preferred embodiment of the present invention, said control unit consists of a converter for converting the difference signals at the output of said comparator into electrical values for controlling said synchronously operating beam and take-up roller motors respectively. The converter is connected to said comparator and has its output connected to a memory unit for storing said electrical control values, the output of said memory unit being connected both to the beam operating motor and to the take-up roller operating motor.

According to a further preferred embodiment of the present invention, enabled by the considerable versatility of the device of the invention which is able to self-predetermine the effective correction values, said sensor for determining the beat-up pulse intensity of said reed acts as a warp tension sensor. In this respect, the reed beat-ups result in sudden variations in the warp tension and hence in tension peaks, the intensity of which is evidently proportional to the beat-up intensity. It is therefore sufficient to take as the set value that warp tension prevailing during normal working, in order to enable the device to prevent defects in the fabric under formation during the transient states following loom stoppages.

According to a further preferred embodiment of the present invention, said reed beat-up pulse intensity sensor consists of a sensor for measuring the deformation of said fixed bar for deviating the fabric under formation in that the reed beat-ups determine peaks in the deformation pattern of said bar, which are evidently also proportional to the beat-up intensity. The invention is described in detail hereinafter with reference to the accompanying drawing, which shows a preferred embodiment thereof by way of non-limiting example in that technical or constructional modifications can be made thereto but without leaving the scope of the present invention.

BRIEF DESCRIPTION OF THE DRAWING

The sole FIGURE of the drawing represents a partly sectional partial perspective view of a loom using the device for varying the shed vertex position in accordance with the invention.

DESCRIPTION OF THE PREFERRED EMBODIMENT(S)

In the FIGURE, the reference numerals 1 and 2 indicate respectively the two fixed loom shoulders supporting the shaft 3 of the warp feed beam 4 which, driven by an electric motor 5 synchronized with the loom drive shaft 40 feeds the warp yarns 6.

Said warp yarns 6 pass about the yarn holder 7 and pass through the heddle frames 8 to form the shed 9, against the vertex 10 of which the reed 11 beats-up the warp yarns inserted into said shed, to form the fabric 12 which is deviated by the fixed deviation bar 13 to pass about the take-up roller 14, about the reversal roller 15 and about the diverting bar 16 to wind onto the beam 17 rotatably supported by said shoulders 1 and 2.

Said take-up roller 14 is driven by an electric motor 18 which is synchronized with said loom drive shaft and hence with said electric motor 5, and rotates at a higher speed than the motor 5 to subject the fabric 12 and the warp yarns 6 to a certain tension.

To said fixed deviation bar 13 there is applied a deformation sensor 19 connected by the leads 20 and 21 to one input of a comparator 22, to the other input of which an adjustable set-value unit 25 is connected by the leads 23 and 24. A typical apparatus, suitable for use with the present invention, for converting the stress applied by warp yarns to a fixed deviation bar into loom motor control signals is described in U.S. Pat. No. 3,878,872 granted Apr. 22, 1975 to O. Hintsch for "Warp Let-Off Means." The output of said comparator 22 is connected by the leads 26 and 27 to a converter 28 which converts the difference signals leaving said comparator 22 into electrical voltage values which are stored, via the leads 29 and 30, in a memory unit 31 connected by the leads 32 and 33 to said drive motor 5 for the beam 4 and by the leads 34 and 35 to said drive motor 18 for the take-up roller 14.

The method of operating such a device is as follows. Having started the loom, the deformation produced under normal working at each beat-up of the reed 11 is determined by the sensor 19 and this value is set in the set-value unit 25 after stopping the loom. The loom, restarted passes through a transient state in which the weft is beaten up by the reed at an intensity less than the working intensity. During the transient state the comparator determines the differences between the deformation values measured by the sensor 19 at each reed beat-up and the value set in 25, these differences being stored in the memory 31 when converted into control voltages for the motors 5 and 18. The loom is stopped and again restarted. Said voltage values stored in the memory 31 will then suitably vary the speed of the motors 5 and 18 and hence the position of the vertex 10 of the shed 9 with the result that the difference values at the output of the comparator 22 will be reduced, to give a new series of voltage values, which will be stored in the memory 31. By successive loom starts and stoppages providing the determinations during the transient state, and hence by successive approximations, the memory 31 will have finally stored the values of the effective series of voltages with which the motors 5 and 18 have to be driven at each loom beat-up pulse intensity during the transient state to always have zero output from the comparator 22. At this point, with the necessary motor control data having been predetermined and memorized, the loom is ready to operate with the assurance of perfect weaving, even during transient state following loom stoppages. Thus, in accordance with the invention the intensity of the reed beat-up pulses during the transient state, as determined by a sensor, are compared with a predetermined set value corresponding to the beat-up pulse intensity during normal working, the resultant positive or negative differences being used to suitably vary, upwards or downwards respectively, the synchronous speeds of the loom beam and take-up roller operating motors.

In this manner, an increase or reduction in the synchronous speed of the two said motors results in the shed vertex moving towards the take-up roller or towards the beam respectively, to produce a variation in said reed beat-up pulses measured by the sensor, and consequently a variation in said differences. By successive approximations during several loom stoppages and restarts, it is hence possible with the device of the invention to predetermine with accuracy for each specific type of fabric under manufacture the corrections to be made to the synchronous speeds of said motors for the various reed beat-ups during the transient state to achieve zero differences, i.e., to achieve reed beat-up intensities during the transient state which are always equal to the intensity during normal working. Said correction values, stored in a memory, are then used automatically to control the motors during the subsequent loom transient states.

We claim:

1. In a loom that has a drive shaft, a device for automatically varying, during the transient states following loom stoppages, the shed vertex position in said loom, in which the loom has a warp feed beam operated by a first electric motor synchronized with the loom drive shaft, a reed for beating up a weft against said shed vertex, a fixed bar for deviating the fabric under formation and a take-up roller operated by a second electric motor also synchronized with the loom drive shaft, the device comprising a sensor for determining the beat-up pulse intensity of said reed by measuring the deformation of said fixed bar for deviating the fabric under formation and connected to a predetermined set value comparator having an output, which comparator also has means for receiving said predetermined set value corresponding to the beat-up pulse intensity of said reed, the output of said comparator being a difference signal used, via a memory unit, to drive said first and second electric motors operating said beam and said take-up roller, said sensor having measured the deformation of said fixed bar for deviating the fabric under formation, whereby said comparator output synchronously drives said first and second electric motors to vary the shed vertex position.

2. A device as claimed in claim 1, in that said memory unit further comprises a converter for converting the difference signal at the output of said comparator into electrical values for controlling said operating beam and take-up roller motors respectively, said converter being coupled to said comparator, said comparator output being connected to said memory unit for storing said electrical control values, the output of said memory unit being coupled both to the beam operating motor and to the take-up roller operating motor.

* * * * *